US008113629B2

(12) United States Patent
Silverbrook

(10) Patent No.: US 8,113,629 B2
(45) Date of Patent: Feb. 14, 2012

(54) INKJET PRINTHEAD INTEGRATED CIRCUIT INCORPORATING FULCRUM ASSISTED INK EJECTION ACTUATOR

(75) Inventor: Kia Silverbrook, Balmain (AU)

(73) Assignee: Silverbrook Research Pty Ltd., Balmain, New South Wales (AU)

( * ) Notice: Subject to any disclaimer, the term of this patent is extended or adjusted under 35 U.S.C. 154(b) by 0 days.

(21) Appl. No.: 13/079,006

(22) Filed: Apr. 3, 2011

(65) Prior Publication Data

US 2011/0175970 A1 Jul. 21, 2011

Related U.S. Application Data

(63) Continuation of application No. 12/482,417, filed on Jun. 10, 2009, now Pat. No. 7,942,503, which is a continuation of application No. 11/766,025, filed on Jun. 20, 2007, now Pat. No. 7,556,356, which is a continuation of application No. 11/442,179, filed on May 30, 2006, now Pat. No. 7,246,884, which is a continuation of application No. 11/172,810, filed on Jul. 5, 2005, now Pat. No. 7,055,935, which is a continuation of application No. 10/962,394, filed on Oct. 13, 2004, now Pat. No. 6,948,799, which is a continuation of application No. 10/713,072, filed on Nov. 17, 2003, now Pat. No. 6,824,251, which is a continuation of application No. 10/302,556, filed on Nov. 23, 2002, now Pat. No. 6,666,543, which is a continuation of application No. 10/120,346, filed on Apr. 12, 2002, now Pat. No. 6,582,059, which is a continuation-in-part of application No. 09/112,767, filed on Jul. 10, 1998, now Pat. No. 6,416,167.

(30) Foreign Application Priority Data

Jul. 15, 1997 (AU) ..... PO7991
Mar. 25, 1998 (AU) ..... PP2592

(51) Int. Cl.
*B41J 2/04* (2006.01)

(52) U.S. Cl. ..... 347/54; 347/59; 347/65

(58) Field of Classification Search ..... 347/20, 347/44, 47, 54, 56–59, 61–65, 67
See application file for complete search history.

(56) References Cited

U.S. PATENT DOCUMENTS 1,941,001 A 12/1933 Hansell
(Continued)

FOREIGN PATENT DOCUMENTS

DE 1648322 A 3/1971
(Continued)

OTHER PUBLICATIONS

Ataka, Manabu et al, "Fabrication and Operation of Polymide Bimorph Actuators for Ciliary Motion System". Journal of Microelectromechanical Systems, US, IEEE Inc, New York, vol. 2, No. 4,Dec. 1, 1993, pp. 146-150, XP000443412, ISSN: 1057-7157.

(Continued)

*Primary Examiner* — Juanita D Stephens

(57) ABSTRACT

An inkjet printhead integrated circuit includes a substrate; a drive circuitry layer positioned on the substrate, the substrate and the drive circuitry layer defining a plurality of ink inlet channels; nozzle chamber walls positioned on the substrate, the nozzle chamber walls supporting roof structures to define nozzle chambers in fluid communication with the ink inlet channels; ink ejection ports defined in the roof structures; ink ejection members positioned in respective nozzle chambers and displaceable with respect to the roof structures to eject ink from the ink ejection ports; fulcrum formations fast with the substrate, each fulcrum formation having an effort formation on one side and a load formation on an opposite side; and thermal actuators outside of and associated with respective nozzle chambers and connected to the drive circuitry layer to move with respect to the substrate on receipt of electrical signals from the drive circuitry layer. Each ink ejection member is fast with a respective load formation. Each effort formation is fast with a respective thermal actuator, whereby reciprocal movement generated by the thermal actuators results in reciprocal movement of the ink ejection members and subsequent ink drop ejection from the ink ejection ports The fulcrum, effort and load formations are composite with a primary layer and a secondary layer.

3 Claims, 2 Drawing Sheets

U.S. PATENT DOCUMENTS

| | | | |
|---|---|---|---|
| 1,983,690 | A | 12/1934 | Behrens |
| 3,294,212 | A | 12/1966 | Gearheart et al. |
| 3,371,437 | A | 3/1968 | Sweet et al. |
| 3,596,275 | A | 7/1971 | Sweet |
| 3,683,212 | A | 8/1972 | Zoltan |
| 3,747,120 | A | 7/1973 | Stemme |
| 3,946,398 | A | 3/1976 | Kyser et al. |
| 4,007,464 | A | 2/1977 | Bassous et al. |
| 4,053,807 | A | 10/1977 | Aozuka et al. |
| 4,097,873 | A | 6/1978 | Martin |
| 4,111,124 | A | 9/1978 | Pascale et al. |
| 4,225,251 | A | 9/1980 | Klimek et al. |
| 4,350,989 | A | 9/1982 | Sagae et al. |
| 4,370,662 | A | 1/1983 | Hou et al. |
| 4,372,694 | A | 2/1983 | Bovio et al. |
| 4,388,343 | A | 6/1983 | Voss et al. |
| 4,423,401 | A | 12/1983 | Mueller |
| 4,456,804 | A | 6/1984 | Lasky et al. |
| 4,458,255 | A | 7/1984 | Giles |
| 4,459,601 | A | 7/1984 | Howkins |
| 4,480,259 | A | 10/1984 | Kruger et al. |
| 4,490,728 | A | 12/1984 | Vaught et al. |
| 4,535,339 | A | 8/1985 | Horike et al. |
| 4,550,326 | A | 10/1985 | Allen et al. |
| 4,553,393 | A | 11/1985 | Ruoff |
| 4,575,619 | A | 3/1986 | Porzky |
| 4,580,148 | A | 4/1986 | Domoto et al. |
| 4,584,590 | A | 4/1986 | Fischbeck et al. |
| 4,611,219 | A | 9/1986 | Sugitani et al. |
| 4,612,554 | A | 9/1986 | Poleshuk |
| 4,623,965 | A | 11/1986 | Wing |
| 4,628,816 | A | 12/1986 | Six |
| 4,665,307 | A | 5/1987 | McWilliams |
| 4,672,398 | A | 6/1987 | Kuwabara et al. |
| 4,694,308 | A | 9/1987 | Chan et al. |
| 4,696,319 | A | 9/1987 | Gant |
| 4,706,095 | A | 11/1987 | Ono et al. |
| 4,725,157 | A | 2/1988 | Nakai et al. |
| 4,728,392 | A | 3/1988 | Mirua et al. |
| 4,733,823 | A | 3/1988 | Waggener et al. |
| 4,737,802 | A | 4/1988 | Mielke |
| 4,746,935 | A | 5/1988 | Allen |
| 4,751,527 | A | 6/1988 | Oda |
| 4,764,041 | A | 8/1988 | Bierhoff |
| 4,784,721 | A | 11/1988 | Holmen et al. |
| 4,812,792 | A | 3/1989 | Leibowitz |
| 4,855,567 | A | 8/1989 | Mueller |
| 4,864,824 | A | 9/1989 | Gabriel et al. |
| 4,870,433 | A | 9/1989 | Campbell et al. |
| 4,887,098 | A | 12/1989 | Hawkins et al. |
| 4,894,664 | A | 1/1990 | Tsung Pan |
| 4,899,180 | A | 2/1990 | Elhatem et al. |
| 4,914,562 | A | 4/1990 | Abe et al. |
| 4,952,950 | A | 8/1990 | Bibl et al. |
| 4,961,821 | A | 10/1990 | Drake et al. |
| 4,962,391 | A | 10/1990 | Kitahara et al. |
| 5,016,023 | A | 5/1991 | Chan et al. |
| 5,029,805 | A | 7/1991 | Albarda et al. |
| 5,048,983 | A | 9/1991 | Fukae |
| 5,051,761 | A | 9/1991 | Fisher et al. |
| 5,057,854 | A | 10/1991 | Pond et al. |
| 5,058,856 | A | 10/1991 | Gordon et al. |
| 5,059,989 | A | 10/1991 | Eldridge et al. |
| 5,072,241 | A | 12/1991 | Shibaike et al. |
| 5,107,276 | A | 4/1992 | Kneezel et al. |
| 5,113,204 | A | 5/1992 | Miyazawa et al. |
| 5,115,374 | A | 5/1992 | Hongoh |
| 5,148,194 | A | 9/1992 | Asai et al. |
| 5,184,907 | A | 2/1993 | Hamada et al. |
| 5,188,464 | A | 2/1993 | Aaron |
| 5,189,473 | A | 2/1993 | Negoro et al. |
| 5,198,836 | A | 3/1993 | Saito et al. |
| 5,211,806 | A | 5/1993 | Wong et al. |
| 5,218,754 | A | 6/1993 | Rangappan |
| 5,245,364 | A | 9/1993 | Uchida et al. |
| 5,255,016 | A | 10/1993 | Usui et al. |
| 5,258,774 | A | 11/1993 | Rogers et al. |
| 5,278,585 | A | 1/1994 | Karz et al. |
| 5,308,442 | A | 5/1994 | Taub et al. |
| 5,317,869 | A | 6/1994 | Takeuchi |
| 5,345,403 | A | 9/1994 | Ogawa et al. |
| 5,358,231 | A | 10/1994 | Andela |
| 5,364,196 | A | 11/1994 | Baitz et al. |
| 5,364,496 | A | 11/1994 | Bollinger et al. |
| 5,387,314 | A | 2/1995 | Baughman et al. |
| 5,397,628 | A | 3/1995 | Crawley et al. |
| 5,406,318 | A | 4/1995 | Moore et al. |
| 5,443,320 | A | 8/1995 | Agata et al. |
| 5,447,442 | A | 9/1995 | Swart |
| 5,448,270 | A | 9/1995 | Osborne |
| 5,459,501 | A | 10/1995 | Lee et al. |
| 5,477,238 | A | 12/1995 | Aharanson et al. |
| 5,494,698 | A | 2/1996 | White et al. |
| 5,508,236 | A | 4/1996 | Chiang et al. |
| 5,513,431 | A | 5/1996 | Ohno et al. |
| 5,519,191 | A | 5/1996 | Ketcham et al. |
| 5,530,792 | A | 6/1996 | Ikeda et al. |
| 5,546,514 | A | 8/1996 | Nishiyama |
| 5,552,812 | A | 9/1996 | Ebinuma et al. |
| 5,565,113 | A | 10/1996 | Hadimioglu et al. |
| 5,565,900 | A | 10/1996 | Cowger et al. |
| 5,581,284 | A | 12/1996 | Hermanson |
| 5,585,792 | A | 12/1996 | Liu et al. |
| 5,605,659 | A | 2/1997 | Moynihan et al. |
| 5,612,723 | A | 3/1997 | Shimura et al. |
| 5,621,524 | A | 4/1997 | Mitani |
| 5,635,966 | A | 6/1997 | Keefe et al. |
| 5,635,968 | A | 6/1997 | Bhaskar et al. |
| 5,638,103 | A | 6/1997 | Obata et al. |
| 5,640,183 | A | 6/1997 | Hackleman |
| 5,646,658 | A | 7/1997 | Thiel et al. |
| 5,659,345 | A | 8/1997 | Altendorf |
| 5,665,249 | A | 9/1997 | Burke et al. |
| 5,666,141 | A | 9/1997 | Matoba et al. |
| 5,675,719 | A | 10/1997 | Matias et al. |
| 5,675,811 | A | 10/1997 | Broedner et al. |
| 5,675,813 | A | 10/1997 | Holmdahl |
| 5,676,475 | A | 10/1997 | Dull |
| 5,684,519 | A | 11/1997 | Matoba et al. |
| 5,697,144 | A | 12/1997 | Mitani et al. |
| 5,719,602 | A | 2/1998 | Hackleman et al. |
| 5,719,604 | A | 2/1998 | Inui et al. |
| 5,726,693 | A | 3/1998 | Sharma et al. |
| 5,738,454 | A | 4/1998 | Zepeda et al. |
| 5,738,799 | A | 4/1998 | Hawkins et al. |
| 5,752,049 | A | 5/1998 | Lee |
| 5,752,303 | A | 5/1998 | Thiel |
| 5,757,407 | A | 5/1998 | Rezanka |
| 5,771,054 | A | 6/1998 | Dudek et al. |
| 5,781,202 | A | 7/1998 | Silverbrook et al. |
| 5,781,331 | A | 7/1998 | Carr et al. |
| 5,790,154 | A | 8/1998 | Mitani et al. |
| 5,801,727 | A | 9/1998 | Torpey |
| 5,802,686 | A | 9/1998 | Shimada et al. |
| 5,804,083 | A | 9/1998 | Ishii et al. |
| 5,812,159 | A | 9/1998 | Anagnostopoulos et al. |
| 5,821,962 | A | 10/1998 | Kudo et al. |
| 5,825,275 | A | 10/1998 | Wuttig et al. |
| 5,828,394 | A | 10/1998 | Khuri-Yakub et al. |
| 5,838,351 | A | 11/1998 | Weber |
| 5,841,452 | A | 11/1998 | Silverbrook |
| 5,845,144 | A | 12/1998 | Tateyama et al. |
| 5,850,240 | A | 12/1998 | Kubatzki et al. |
| 5,850,242 | A | 12/1998 | Asaba |
| 5,851,412 | A | 12/1998 | Kubby |
| 5,872,582 | A | 2/1999 | Pan |
| 5,877,580 | A | 3/1999 | Swierkowski |
| 5,883,650 | A | 3/1999 | Figueredo et al. |
| 5,889,541 | A | 3/1999 | Bobrow et al. |
| 5,896,155 | A | 4/1999 | Lebens et al. |
| 5,897,789 | A | 4/1999 | Weber |
| 5,903,380 | A | 5/1999 | Motamedi et al. |
| 5,909,230 | A | 6/1999 | Choi et al. |
| 5,912,684 | A | 6/1999 | Fujii et al. |
| 5,940,096 | A | 8/1999 | Komplin et al. |
| 5,980,719 | A | 11/1999 | Cherukuri et al. |
| 5,994,816 | A | 11/1999 | Dhuler et al. |

6,000,781 A 12/1999 Akiyama et al.
6,003,668 A 12/1999 Joyce
6,003,977 A 12/1999 Weber et al.
6,007,187 A 12/1999 Kashino et al.
6,019,457 A 2/2000 Silverbrook
6,022,099 A 2/2000 Chwalek et al.
6,022,104 A 2/2000 Lin et al.
6,022,482 A 2/2000 Chen et al.
6,027,205 A 2/2000 Herbert
6,041,600 A 3/2000 Silverbrook
6,062,681 A 5/2000 Field et al.
6,067,797 A 5/2000 Silverbrook
6,068,367 A 5/2000 Fabbri
6,070,967 A 6/2000 Bern
6,074,043 A 6/2000 Ahn
6,076,913 A 6/2000 Garcia et al.
6,079,821 A 6/2000 Chwalek et al.
6,084,609 A 7/2000 Manini et al.
6,087,638 A 7/2000 Silverbrook
6,092,889 A 7/2000 Nakamoto et al.
6,106,115 A 8/2000 Mueller et al.
6,120,124 A 9/2000 Atobe et al.
6,123,316 A 9/2000 Biegelsen et al.
6,126,846 A 10/2000 Silverbrook
6,130,967 A 10/2000 Lee et al.
6,143,432 A 11/2000 de Rochemont et al.
6,151,049 A 11/2000 Karita et al.
6,155,676 A 12/2000 Etheridge et al.
6,171,875 B1 1/2001 Silverbrook
6,174,050 B1 1/2001 Kashino et al.
6,180,427 B1 1/2001 Silverbrook
6,183,067 B1 2/2001 Matta
6,188,415 B1 2/2001 Silverbrook
6,191,405 B1 2/2001 Mishima et al.
6,209,989 B1 4/2001 Silverbrook
6,211,598 B1 4/2001 Dhuler et al.
6,213,589 B1 4/2001 Silverbrook
6,217,183 B1 4/2001 Shipman
6,220,694 B1 4/2001 Silverbrook
6,228,668 B1 5/2001 Silverbrook
6,229,622 B1 5/2001 Takeda
6,231,772 B1 5/2001 Silverbrook
6,234,472 B1 5/2001 Juan
6,234,608 B1 5/2001 Genovese et al.
6,238,040 B1 5/2001 Silverbrook
6,238,113 B1 5/2001 Dodge
6,239,821 B1 5/2001 Silverbrook
6,241,906 B1 6/2001 Silverbrook
6,243,113 B1 6/2001 Silverbrook
6,244,691 B1 6/2001 Silverbrook
6,245,246 B1 6/2001 Silverbrook
6,245,247 B1 6/2001 Silverbrook
6,247,789 B1 6/2001 Sanada
6,247,790 B1 6/2001 Silverbrook et al.
6,247,791 B1 6/2001 Silverbrook
6,247,792 B1 6/2001 Silverbrook
6,247,795 B1 6/2001 Silverbrook
6,247,796 B1 6/2001 Silverbrook
6,254,793 B1 7/2001 Silverbrook
6,258,285 B1 7/2001 Silverbrook
6,264,849 B1 7/2001 Silverbrook
6,267,904 B1 7/2001 Silverbrook
6,274,056 B1 8/2001 Silverbrook
6,283,582 B1 9/2001 Silverbrook
6,290,332 B1 9/2001 Crystal et al.
6,290,862 B1 9/2001 Silverbrook
6,294,101 B1 9/2001 Silverbrook
6,294,347 B1 9/2001 Peltz et al.
6,297,577 B1 10/2001 Hotomi et al.
6,302,528 B1 10/2001 Silverbrook
6,305,773 B1 10/2001 Burr et al.
6,306,671 B1 10/2001 Silverbrook
6,312,099 B1 11/2001 Hawkins et al.
6,315,470 B1 11/2001 Vaghi
6,322,195 B1 11/2001 Silverbrook
6,331,043 B1 12/2001 Shimazu et al.
6,331,258 B1 12/2001 Silverbrook
6,341,845 B1 1/2002 Scheffelin et al.
6,352,337 B1 3/2002 Sharma
6,357,115 B1 3/2002 Takatsuka et al.
6,361,230 B1 3/2002 Crystal et al.
6,416,167 B1 7/2002 Silverbrook
6,416,168 B1 7/2002 Silverbrook
6,426,014 B1 7/2002 Silverbrook
6,435,667 B1 8/2002 Silverbrook
6,443,555 B1 9/2002 Silverbrook et al.
6,451,216 B1 9/2002 Silverbrook
6,452,588 B2 9/2002 Griffin et al.
6,464,415 B1 10/2002 Vaghi
6,467,870 B2 10/2002 Matsumoto et al.
6,471,336 B2 10/2002 Silverbrook
6,474,882 B1 11/2002 Vaghi
6,477,794 B1 11/2002 Hoffmann
6,485,123 B2 11/2002 Silverbrook
6,488,358 B2 12/2002 Silverbrook
6,488,359 B2 12/2002 Silverbrook
6,488,360 B2 12/2002 Silverbrook
6,502,306 B2 1/2003 Silverbrook
6,505,912 B2 1/2003 Silverbrook et al.
6,513,908 B2 2/2003 Silverbrook
6,536,874 B1 3/2003 Silverbrook
6,540,332 B2 4/2003 Silverbrook
6,555,201 B1 4/2003 Dhuler et al.
6,561,627 B2 5/2003 Jarrold et al.
6,561,635 B1 5/2003 Wen
6,582,059 B2 6/2003 Silverbrook
6,588,882 B2 7/2003 Silverbrook
6,598,960 B1 7/2003 Cabel et al.
6,639,488 B2 10/2003 Deligianni et al.
6,641,315 B2 11/2003 King et al.
6,644,767 B2 11/2003 Silverbrook
6,644,786 B1 11/2003 Lebens
6,666,543 B2 12/2003 Silverbrook
6,669,332 B2 12/2003 Silverbrook
6,669,333 B1 12/2003 Silverbrook
6,672,706 B2 1/2004 Silverbrook
6,679,584 B2 1/2004 Silverbrook
6,682,174 B2 1/2004 Silverbrook
6,685,302 B2 2/2004 Haluzak et al.
6,685,303 B1 2/2004 Trauernicht et al.
6,715,949 B1 4/2004 Fisher et al.
6,720,851 B2 4/2004 Halljorner et al.
6,736,490 B2 5/2004 Sugioka
6,783,217 B2 8/2004 Silverbrook
6,786,570 B2 9/2004 Silverbrook
6,786,661 B2 9/2004 King et al.
6,792,754 B2 9/2004 Silverbrook
6,808,325 B2 10/2004 King et al.
6,824,251 B2 11/2004 Silverbrook
6,830,395 B2 12/2004 King et al.
6,832,828 B2 12/2004 Silverbrook
6,834,939 B2 12/2004 Silverbrook
6,840,600 B2 1/2005 Silverbrook
6,848,780 B2 2/2005 Silverbrook
6,855,264 B1 2/2005 Silverbrook
6,857,724 B2 2/2005 Silverbrook
6,857,730 B2 2/2005 Silverbrook
6,866,369 B2 3/2005 Silverbrook
6,874,866 B2 4/2005 Silverbrook
6,880,918 B2 4/2005 Silverbrook
6,886,917 B2 5/2005 Silverbrook et al.
6,886,918 B2 5/2005 Silverbrook et al.
6,913,346 B2 7/2005 Silverbrook et al.
6,916,082 B2 7/2005 Silverbrook
6,918,707 B2 7/2005 King et al.
6,921,221 B2 7/2005 King et al.
6,923,583 B2 8/2005 King et al.
6,929,352 B2 8/2005 Silverbrook
6,932,459 B2 8/2005 Silverbrook
6,945,630 B2 9/2005 Silverbrook
6,948,799 B2 9/2005 Silverbrook
6,953,295 B2 10/2005 King et al.
6,959,981 B2 11/2005 Silverbrook et al.
6,966,625 B2 11/2005 Silverbrook et al.
6,969,153 B2 11/2005 Silverbrook et al.
6,979,075 B2 12/2005 Silverbrook et al.
6,986,613 B2 1/2006 King et al.
6,988,787 B2 1/2006 Silverbrook

| | | | | |
|---|---|---|---|---|
| 6,988,788 | B2 | 1/2006 | Silverbrook | |
| 6,988,841 | B2 | 1/2006 | King et al. | |
| 6,994,420 | B2 | 2/2006 | Silverbrook | |
| 7,004,566 | B2 | 2/2006 | Silverbrook | |
| 7,008,046 | B2 | 3/2006 | Silverbrook | |
| 7,011,390 | B2 | 3/2006 | Silverbrook et al. | |
| 7,055,934 | B2 | 6/2006 | Silverbrook | |
| 7,055,935 | B2 | 6/2006 | Silverbrook | |
| 7,077,507 | B2 | 7/2006 | Silverbrook | |
| 7,077,508 | B2 | 7/2006 | Silverbrook | |
| 7,077,588 | B2 | 7/2006 | King et al. | |
| 7,083,264 | B2 | 8/2006 | Silverbrook | |
| 7,090,337 | B2 | 8/2006 | Silverbrook | |
| 7,101,096 | B2 | 9/2006 | Sasai et al. | |
| 7,111,925 | B2 | 9/2006 | Silverbrook | |
| 7,131,715 | B2 | 11/2006 | Silverbrook | |
| 7,134,740 | B2 | 11/2006 | Silverbrook | |
| 7,134,745 | B2 | 11/2006 | Silverbrook | |
| 7,144,098 | B2 | 12/2006 | Silverbrook | |
| 7,147,302 | B2 | 12/2006 | Silverbrook | |
| 7,147,303 | B2 | 12/2006 | Silverbrook et al. | |
| 7,147,305 | B2 | 12/2006 | Silverbrook | |
| 7,147,791 | B2 | 12/2006 | Silverbrook | |
| 7,156,494 | B2 | 1/2007 | Silverbrook et al. | |
| 7,156,495 | B2 | 1/2007 | Silverbrook et al. | |
| 7,179,395 | B2 | 2/2007 | Silverbrook et al. | |
| 7,182,436 | B2 | 2/2007 | Silverbrook et al. | |
| 7,188,933 | B2 | 3/2007 | Silverbrook et al. | |
| 7,195,339 | B2 | 3/2007 | Silverbrook | |
| 7,217,048 | B2 | 5/2007 | King et al. | |
| 7,246,883 | B2 | 7/2007 | Silverbrook | |
| 7,264,335 | B2 | 9/2007 | Silverbrook et al. | |
| 7,270,492 | B2 | 9/2007 | King et al. | |
| 7,278,711 | B2 | 10/2007 | Silverbrook | |
| 7,278,712 | B2 | 10/2007 | Silverbrook | |
| 7,278,796 | B2 | 10/2007 | King et al. | |
| 7,284,838 | B2 | 10/2007 | Silverbrook et al. | |
| 7,287,834 | B2 | 10/2007 | Silverbrook | |
| 7,303,254 | B2 | 12/2007 | Silverbrook | |
| 7,322,679 | B2 | 1/2008 | Silverbrook | |
| 7,334,873 | B2 | 2/2008 | Silverbrook | |
| 7,347,536 | B2 | 3/2008 | Silverbrook et al. | |
| 7,364,271 | B2 | 4/2008 | Silverbrook | |
| 7,367,729 | B2 | 5/2008 | King et al. | |
| 7,401,902 | B2 | 7/2008 | Silverbrook | |
| 7,416,282 | B2 | 8/2008 | Silverbrook | |
| 7,438,391 | B2 | 10/2008 | Silverbrook et al. | |
| 7,465,023 | B2 | 12/2008 | Silverbrook | |
| 7,465,027 | B2 | 12/2008 | Silverbrook | |
| 7,465,029 | B2 | 12/2008 | Silverbrook et al. | |
| 7,465,030 | B2 | 12/2008 | Silverbrook | |
| 7,467,855 | B2 | 12/2008 | Silverbrook | |
| 7,470,003 | B2 | 12/2008 | Silverbrook | |
| 7,506,965 | B2 * | 3/2009 | Silverbrook | 347/54 |
| 7,506,969 | B2 | 3/2009 | Silverbrook | |
| 7,517,057 | B2 | 4/2009 | Silverbrook | |
| 7,520,593 | B2 | 4/2009 | Silverbrook et al. | |
| 7,520,594 | B2 | 4/2009 | Silverbrook | |
| 7,533,967 | B2 | 5/2009 | Silverbrook et al. | |
| 7,537,301 | B2 | 5/2009 | Silverbrook | |
| 7,537,314 | B2 | 5/2009 | Silverbrook | |
| 7,549,731 | B2 | 6/2009 | Silverbrook | |
| 7,556,351 | B2 | 7/2009 | Silverbrook | |
| 7,556,355 | B2 | 7/2009 | Silverbrook | |
| 7,556,356 | B1 | 7/2009 | Silverbrook | |
| 7,562,967 | B2 | 7/2009 | Silverbrook et al. | |
| 7,566,114 | B2 | 7/2009 | Silverbrook | |
| 7,568,790 | B2 | 8/2009 | Silverbrook et al. | |
| 7,568,791 | B2 | 8/2009 | Silverbrook | |
| 7,578,582 | B2 | 8/2009 | Silverbrook | |
| 7,604,323 | B2 | 10/2009 | Silverbrook et al. | |
| 7,611,227 | B2 | 11/2009 | Silverbrook | |
| 7,628,471 | B2 | 12/2009 | Silverbrook | |
| 7,637,594 | B2 | 12/2009 | Silverbrook et al. | |
| 7,641,314 | B2 | 1/2010 | Silverbrook | |
| 7,641,315 | B2 | 1/2010 | Silverbrook | |
| 7,669,973 | B2 | 3/2010 | Silverbrook et al. | |
| 7,708,386 | B2 | 5/2010 | Silverbrook et al. | |
| 7,717,543 | B2 | 5/2010 | Silverbrook | |
| 7,758,161 | B2 | 7/2010 | Silverbrook et al. | |
| 7,780,269 | B2 | 8/2010 | Silverbrook | |
| 7,802,871 | B2 | 9/2010 | Silverbrook | |
| 7,850,282 | B2 | 12/2010 | Silverbrook | |
| 7,866,797 | B2 * | 1/2011 | Silverbrook | 347/54 |
| 7,891,779 | B2 | 2/2011 | Silverbrook | |
| 7,901,048 | B2 | 3/2011 | Silverbrook | |
| 7,901,049 | B2 | 3/2011 | Silverbrook | |
| 2001/0000447 | A1 | 4/2001 | Thompson | |
| 2001/0006394 | A1 | 7/2001 | Silverbrook | |
| 2001/0007461 | A1 | 7/2001 | Silverbrook | |
| 2001/0008406 | A1 | 7/2001 | Silverbrook | |
| 2001/0008409 | A1 | 7/2001 | Sliverbrook | |
| 2001/0009430 | A1 | 7/2001 | Silverbrook | |
| 2001/0017089 | A1 | 8/2001 | Fujii et al. | |
| 2001/0024590 | A1 | 9/2001 | Woodman et al. | |
| 2002/0089695 | A1 | 7/2002 | Kuboto | |
| 2002/0180834 | A1 | 12/2002 | Silverbrook | |
| 2003/0095726 | A1 | 5/2003 | Kia et al. | |
| 2003/0103106 | A1 | 6/2003 | Silverbrook | |
| 2003/0103109 | A1 | 6/2003 | Silverbrook | |
| 2003/0231227 | A1 | 12/2003 | Kim | |
| 2004/0070648 | A1 | 4/2004 | Silverbrook | |
| 2004/0088468 | A1 | 5/2004 | Hasegawa | |
| 2004/0095436 | A1 | 5/2004 | Silverbrook | |
| 2004/0257403 | A1 | 12/2004 | Silverbrook | |
| 2005/0128252 | A1 | 6/2005 | Silverbrook | |
| 2005/0140727 | A1 | 6/2005 | Silverbrook | |
| 2005/0226668 | A1 | 10/2005 | King et al. | |
| 2005/0232676 | A1 | 10/2005 | King et al. | |
| 2007/0097194 | A1 | 5/2007 | Silverbrook | |
| 2008/0204514 | A1 | 8/2008 | Silverbrook | |
| 2008/0316269 | A1 | 12/2008 | Silverbrook et al. | |

FOREIGN PATENT DOCUMENTS

| | | | |
|---|---|---|---|
| DE | 1648322 | A1 | 3/1971 |
| DE | 2905063 | A | 8/1980 |
| DE | 2905063 | A1 | 8/1980 |
| DE | 3245283 | A | 6/1984 |
| DE | 3430155 | A | 2/1986 |
| DE | 8802281 | U1 | 5/1988 |
| DE | 3716996 | A | 12/1988 |
| DE | 3716996 | A1 | 12/1988 |
| DE | 3934280 | A | 4/1990 |
| DE | 4031248 | A1 | 4/1992 |
| DE | 4328433 | A | 3/1995 |
| DE | 19516997 | A | 11/1995 |
| DE | 19516997 | A1 | 11/1995 |
| DE | 19517969 | A | 11/1995 |
| DE | 19517969 | A1 | 11/1995 |
| DE | 19532913 | A | 3/1996 |
| DE | 19623620 | A1 | 12/1996 |
| DE | 19639717 | A | 4/1997 |
| DE | 19639717 | A1 | 4/1997 |
| EP | 0092229 | A | 10/1983 |
| EP | 0398031 | A | 11/1990 |
| EP | 0416540 | A2 | 3/1991 |
| EP | 0427291 | A | 5/1991 |
| EP | 0431338 | A | 6/1991 |
| EP | 04-118241 | A | 4/1992 |
| EP | 0478956 | A | 4/1992 |
| EP | 0506232 | A | 9/1992 |
| EP | 0510648 | A | 10/1992 |
| EP | 0627314 | A | 12/1994 |
| EP | 0634273 | A | 1/1995 |
| EP | 0634273 | A2 | 1/1995 |
| EP | 0713774 | A2 | 5/1996 |
| EP | 0737580 | A | 10/1996 |
| EP | 0750993 | A | 1/1997 |
| EP | 0882590 | A | 12/1998 |
| FR | 2231076 | A | 12/1974 |
| GB | 792145 | A | 3/1958 |
| GB | 1428239 | A | 3/1976 |
| GB | 2227020 | A | 7/1990 |
| GB | 2262152 | A | 6/1993 |
| JP | 56-010472 | | 2/1981 |
| JP | 58-112747 | A | 7/1983 |
| JP | 58-116165 | A | 7/1983 |
| JP | 61-025849 | A | 2/1986 |

| | | | |
|---|---|---|---|
| JP | 61-268453 | A | 11/1986 |
| JP | 62-094347 | | 4/1987 |
| JP | 01-048124 | A | 2/1989 |
| JP | 01-105746 | A | 4/1989 |
| JP | 01-115639 | A | 5/1989 |
| JP | 01-115693 | A | 5/1989 |
| JP | 01-128839 | A | 5/1989 |
| JP | 01-257058 | A | 10/1989 |
| JP | 01-306254 | A | 12/1989 |
| JP | 02-030543 | A | 1/1990 |
| JP | 02-050841 | A | 2/1990 |
| JP | 02-092643 | A | 4/1990 |
| JP | 02-108544 | A | 4/1990 |
| JP | 02-158348 | A | 6/1990 |
| JP | 02-162049 | A | 6/1990 |
| JP | 02-265752 | A | 10/1990 |
| JP | 03-009846 | | 1/1991 |
| JP | 03-009846 | A | 1/1991 |
| JP | 03-065348 | A | 3/1991 |
| JP | 0416540 | | 3/1991 |
| JP | 03-112662 | A | 5/1991 |
| JP | 03-153359 | A | 7/1991 |
| JP | 403153359 | A | 7/1991 |
| JP | 03-180350 | A | 8/1991 |
| JP | 03-213346 | A | 9/1991 |
| JP | 403292147 | A | 12/1991 |
| JP | 04-001051 | | 1/1992 |
| JP | 04-001051 | A | 1/1992 |
| JP | 04-126255 | A | 4/1992 |
| JP | 04-141429 | A | 5/1992 |
| JP | 404325257 | | 11/1992 |
| JP | 404325257 | A | 11/1992 |
| JP | 04-353458 | A | 12/1992 |
| JP | 04-368851 | A | 12/1992 |
| JP | 05-108278 | | 4/1993 |
| JP | 05-284765 | A | 10/1993 |
| JP | 05-318724 | A | 12/1993 |
| JP | 405318724 | | 12/1993 |
| JP | 06-091865 | A | 4/1994 |
| JP | 06-091866 | A | 4/1994 |
| JP | 07-125241 | A | 5/1995 |
| JP | 07-314665 | A | 4/1996 |
| JP | 08-142323 | | 6/1996 |
| JP | 08-336965 | | 12/1996 |
| JP | 411034328 | A | 2/1999 |
| JP | 11212703 | A | 8/1999 |
| WO | WO 94/18010 | A | 8/1994 |
| WO | WO 96/32260 | | 10/1996 |
| WO | WO 96/32283 | | 10/1996 |
| WO | WO 97/12689 | A | 4/1997 |
| WO | WO 99/03681 | | 1/1999 |
| WO | WO 99/03681 | A1 | 1/1999 |

OTHER PUBLICATIONS

Egawa et al., "Micro-Electro Mechanical Systems" IEEE Catalog No. 90CH2832-4, Feb. 1990, pp. 166-171.

Hirata et al., "An Ink-jet Head Using Diaphragm Microactuator" Sharp Corporation, Jun. 1996, pp. 418-423.

Noworolski J M et al: "Process for in-plane and out-of-plane single-crystal-silicon thermal microactuators" Sensors and Actuators A, Ch. Elsevier Sequoia S.A., Lausane, vol. 55, No. 1, Jul. 15, 1996, pp. 65-69, XP004077979.

Smith et al., "Ink Jet Pump" IBM Technical Disclosure Bulletin, vol. 20 , No. 2, Jul. 1977, pp. 560-562.

Yamagata, Yutaka et al, "A Micro Mobile Mechanism Using Thermal Expansion and its Theoretical Analysis". Proceedings of the workshop on micro electro mechanical systems (MEMS), US, New York, IEEE, vol. Workshop 7, Jan. 25, 1994, pp. 142-147, XP000528408, ISBN: 0-7803-1834-X.

* cited by examiner

INKJET PRINTHEAD INTEGRATED CIRCUIT INCORPORATING FULCRUM ASSISTED INK EJECTION ACTUATOR

CROSS-REFERENCE TO RELATED APPLICATIONS

The present application is a Continuation of U.S. application Ser. No. 12/482,417 filed Jun. 10, 2009, now issued U.S. Pat. No. 7,942,503 which is a Continuation of U.S. application Ser. No. 11/766,025 filed Jun. 20, 2007, now issued U.S. Pat. No. 7,556,356, which is a Continuation of U.S. application Ser. No. 11/442,179 filed May 30, 2006, now issued U.S. Pat. No. 7,246,884, which is a Continuation of U.S. application Ser. No. 11/172,810 filed Jul. 5, 2005, now issued U.S. Pat. No. 7,055,935, which is a Continuation of U.S. application Ser. No. 10/962,394 filed on Oct. 13, 2004, now issued U.S. Pat. No. 6,948,799, which is a Continuation of U.S. application Ser. No. 10/713,072 filed Nov. 17, 2003, now U.S. Pat. No. 6,824,251, which is a Continuation of U.S. application Ser. No. 10/302,556 filed Nov. 23, 2002, now issued U.S. Pat. No. 6,666,543, which is a Continuation of U.S. application Ser. No. 10/120,346 filed Apr. 12, 2002, now issued U.S. Pat. No. 6,582,059, which is a Continuation-in-Part of U.S. application Ser. No. 09/112,767 filed Jul. 10, 1998, now issued U.S. Pat. No. 6,416,167 all of which are herein incorporated by reference.

FIELD OF THE INVENTION

This invention relates to a micro-electromechanical fluid ejecting device. More particularly, this invention relates to a micro-electromechanical fluid ejecting device which incorporates a covering formation for a micro-electromechanical actuator.

REFERENCED PATENT APPLICATIONS

The following patents/patent applications are incorporated by reference.

| | | | | | |
|---|---|---|---|---|---|
| 6,362,868 | 6,227,652 | 6,213,588 | 6,213,589 | 6,231,163 | 6,247,795 |
| 6,394,581 | 6,244,691 | 6,257,704 | 6,416,168 | 6,220,694 | 6,257,705 |
| 6,247,794 | 6,234,610 | 6,247,793 | 6,264,306 | 6,241,342 | 6,247,792 |
| 6,264,307 | 6,254,220 | 6,234,611 | 6,302,528 | 6,283,582 | 6,239,821 |
| 6,338,547 | 6,247,796 | 6,557,977 | 6,390,603 | 6,362,843 | 6,293,653 |
| 6,312,107 | 6,227,653 | 6,234,609 | 6,238,040 | 6,188,415 | 6,227,654 |
| 6,209,989 | 6,247,791 | 6,336,710 | 6,217,153 | 6,416,167 | 6,243,113 |
| 6,283,581 | 6,247,790 | 6,260,953 | 6,267,469 | 6,273,544 | 6,309,048 |
| 6,420,196 | 6,443,558 | 6,439,689 | 6,378,989 | 6,848,181 | 6,634,735 |
| 6,623,101 | 6,406,129 | 6,505,916 | 6,457,809 | 6,550,895 | 6,457,812 |
| 6,428,133 | 6,485,123 | 6,425,657 | 6,488,358 | 7,021,746 | 6,712,986 |
| 6,981,757 | 6,505,912 | 6,439,694 | 6,364,461 | 6,378,990 | 6,425,658 |
| 6,488,361 | 6,814,429 | 6,471,336 | 6,457,813 | 6,540,331 | 6,454,396 |
| 6,464,325 | 6,443,559 | 6,435,664 | 6,488,360 | 6,550,896 | 6,439,695 |
| 6,447,100 | 7,381,340 | 6,488,359 | 6,618,117 | 6,803,989 | 7,044,589 |
| 6,416,154 | 6,547,364 | 6,644,771 | 6,565,181 | 6,857,719 | 6,702,417 |
| 6,918,654 | 6,616,271 | 6,623,108 | 6,625,874 | 6,547,368 | 6,508,546 |

BACKGROUND OF THE INVENTION

As set out in the above referenced applications/patents, the Applicant has spent a substantial amount of time and effort in developing printheads that incorporate micro electro-mechanical system (MEMS)-based components to achieve the ejection of ink necessary for printing.

As a result of the Applicant's research and development, the Applicant has been able to develop printheads having one or more printhead chips that together incorporate up to 84 000 nozzle arrangements. The Applicant has also developed suitable processor technology that is capable of controlling operation of such printheads. In particular, the processor technology and the printheads are capable of cooperating to generate resolutions of 1600 dpi and higher in some cases. Examples of suitable processor technology are provided in the above referenced patent applications/patents.

The Applicant has overcome substantial difficulties in achieving the necessary ink flow and ink drop separation within the ink jet printheads. A number of printhead chips that the Applicant has developed incorporate nozzle arrangements that each have a nozzle chamber with an ink ejection member positioned in the nozzle chamber. The ink ejection member is then displaceable within the nozzle chamber to eject ink from the nozzle chamber.

A particular difficulty that the Applicant addresses in the present invention is to do with the delicate nature of the various components that comprise each nozzle arrangement of the printhead chip. In the above referenced matters, the various components are often exposed as a requirement of their function. On the MEMS scale, the various components are well suited for their particular tasks and the Applicant has found them to be suitably robust.

However, on a macroscopic scale, the various components can easily be damaged by such factors as handling and ingress of microscopic detritus. This microscopic detritus can take the form of paper dust.

It is therefore desirable that a means be provided whereby the components are protected. Applicant has found, however, that it is difficult to fabricate a suitable covering for the components while still achieving a transfer of force to an ink-ejecting component and efficient sealing of a nozzle chamber.

The Applicant has conceived this invention in order to address these difficulties.

SUMMARY OF THE INVENTION

According to an aspect of the present disclosure, an inkjet printhead integrated circuit comprises a substrate; a drive circuitry layer positioned on the substrate, the substrate and the drive circuitry layer defining a plurality of ink inlet channels; nozzle chamber walls positioned on the substrate, the nozzle chamber walls supporting roof structures to define nozzle chambers in fluid communication with the ink inlet channels; ink ejection ports defined in the roof structures; ink ejection members positioned in respective nozzle chambers and displaceable with respect to the roof structures to eject ink from the ink ejection ports; fulcrum formations fast with the substrate, each fulcrum formation having an effort formation on one side and a load formation on an opposite side; and thermal actuators outside of and associated with respective nozzle chambers and connected to the drive circuitry layer to move with respect to the substrate on receipt of electrical signals from the drive circuitry layer. Each ink ejection member is fast with a respective load formation. Each effort formation is fast with a respective thermal actuator, whereby reciprocal movement generated by the thermal actuators results in reciprocal movement of the ink ejection members and subsequent ink drop ejection from the ink ejection ports The fulcrum, effort and load formations are composite with a primary layer and a secondary layer.

DETAILED DESCRIPTION OF THE INVENTION

Figure 1:
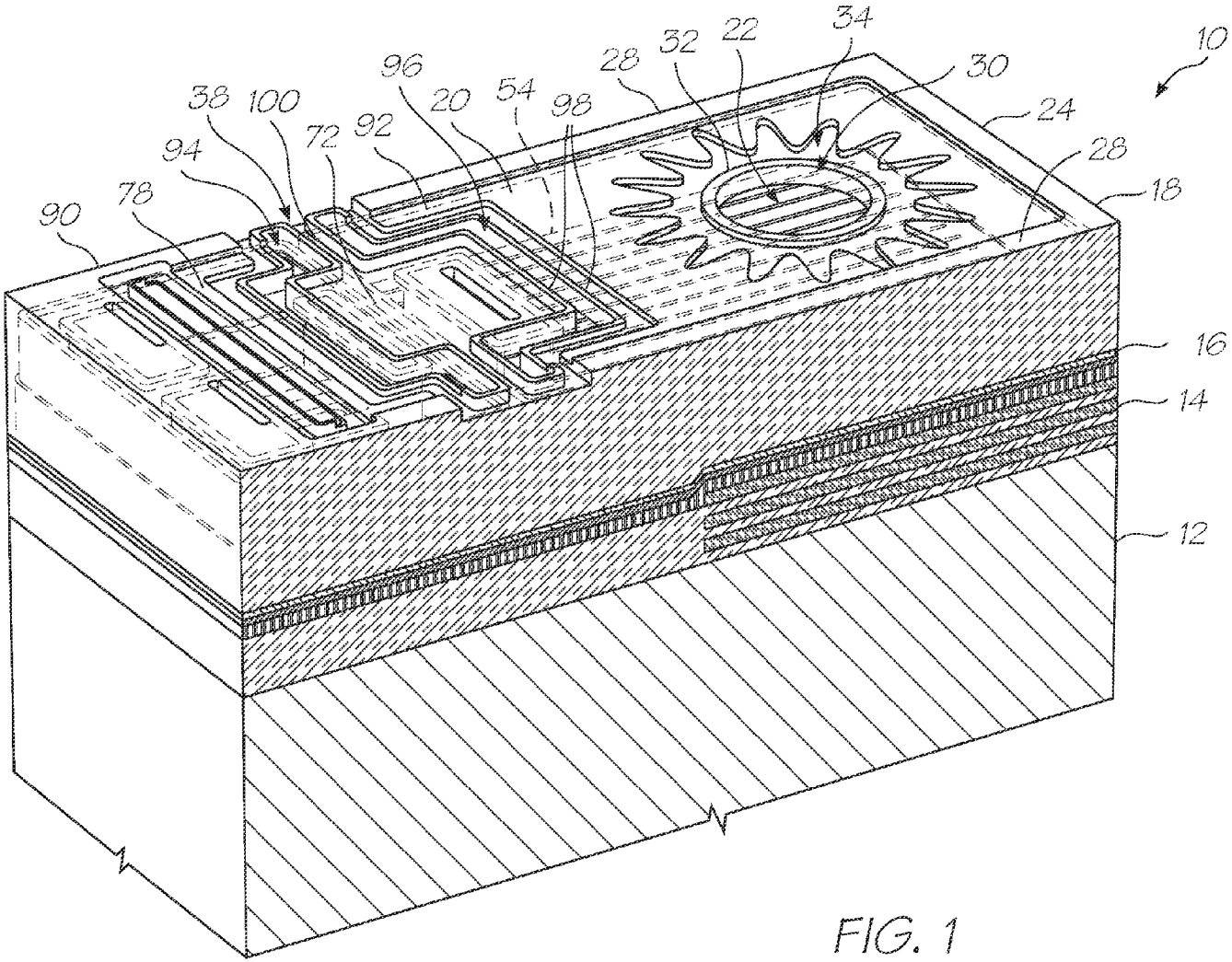
FIG. 1 shows a sectioned, three dimensional view of a nozzle arrangement of a printhead chip, in accordance with the invention, for an inkjet printhead.
Figure 2:
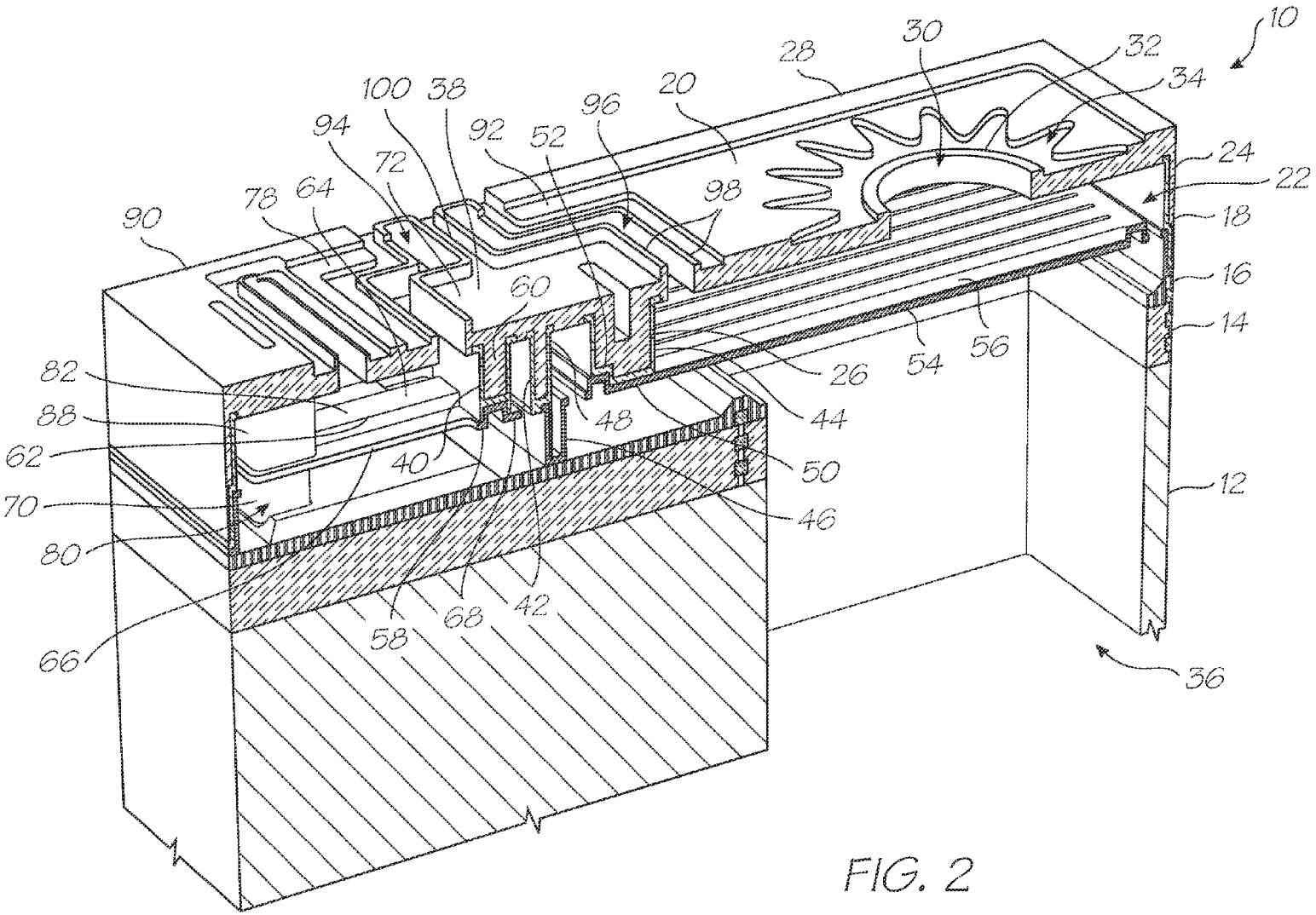
FIG. 2 shows a three dimensional view of the nozzle arrangement of FIG. 1.

In the drawings, reference numeral 10 generally indicates a nozzle arrangement for a first embodiment of an ink jet printhead chip, in accordance with the invention.

The nozzle arrangement 10 is one of a plurality of such nozzle arrangements formed on a silicon wafer substrate 12 to define the printhead chip of the invention. As set out in the background of this specification, a single printhead can contain up to 84 000 such nozzle arrangements. For the purposes of clarity and ease of description, only one nozzle arrangement is described. It is to be appreciated that a person of ordinary skill in the field can readily obtain the printhead chip by simply replicating the nozzle arrangement 10 on the wafer substrate 12.

The printhead chip is the product of an integrated circuit fabrication technique. In particular, each nozzle arrangement 10 is the product of a MEMS-based fabrication technique. As is known, such a fabrication technique involves the deposition of functional layers and sacrificial layers of integrated circuit materials. The functional layers are etched to define various moving components and the sacrificial layers are etched away to release the components. As is known, such fabrication techniques generally involve the replication of a large number of similar components on a single wafer that is subsequently diced to separate the various components from each other. This reinforces the submission that a person of ordinary skill in the field can readily obtain the printhead chip of this invention by replicating the nozzle arrangement 10.

An electrical drive circuitry layer 14 is positioned on the silicon wafer substrate 12. The electrical drive circuitry layer 14 includes CMOS drive circuitry. The particular configuration of the CMOS drive circuitry is not important to this description and has therefore been shown schematically in the drawings. Suffice to say that it is connected to a suitable microprocessor and provides electrical current to the nozzle arrangement 10 upon receipt of an enabling signal from said suitable microprocessor. An example of a suitable microprocessor is described in the above referenced patents/patent applications. It follows that this level of detail will not be set out in this specification.

An ink passivation layer 16 is positioned on the drive circuitry layer 14. The ink passivation layer 16 can be of any suitable material, such as silicon nitride.

The nozzle arrangement 10 includes nozzle chamber walls 18 positioned on the ink passivation layer 16. A roof 20 is positioned on the nozzle chamber walls 18 so that the roof 20 and the nozzle chamber walls 18 define a nozzle chamber 22. The nozzle chamber walls 18 include a distal end wall 24, a proximal end wall 26 and a pair of opposed sidewalls 28. An ink ejection port 30 is defined in the roof 20 to be in fluid communication with the nozzle chamber 22. The roof 20 defines a nozzle rim 32 and a recess 34 positioned about the rim 32 to accommodate ink spread.

The walls 18 and the roof 20 are configured so that the nozzle chamber 22 is rectangular in plan.

A plurality of ink inlet channels 36, one of which is shown in the drawings, is defined through the substrate 12, the drive circuitry layer 14 and the ink passivation layer 16. The ink inlet channel 36 is in fluid communication with the nozzle chamber 18 so that ink can be supplied to the nozzle chamber 18.

The nozzle arrangement 10 includes a work-transmitting structure in the form of a lever mechanism 38. The lever mechanism 38 includes an effort formation 40, a fulcrum formation 42 and a load formation 44. The fulcrum formation 42 is interposed between the effort formation 40 and the load formation 44.

The fulcrum formation 42 is fast with the ink passivation layer 16. In particular, the fulcrum formation 42 is composite with a primary layer 46 and a secondary layer 48. The layers 46, 48 are configured so that the fulcrum formation 42 is resiliently deformable to permit pivotal movement of the fulcrum formation 42 with respect to the substrate 12. The layers 46, 48 can be of a number of materials that are used in integrated circuit fabrication. The Applicant has found that titanium aluminum nitride (TiAlN) is a suitable material for the layer 46 and that titanium is a suitable material for the layer 48.

The load formation 44 defines part of the proximal end wall 26. The load formation 44 is composite with a primary layer 50 and a secondary layer 52. As with the fulcrum formation 42, the layers 50, 52 can be of any of a number of materials that are used in integrated circuit fabrication. However, as set out above, the nozzle arrangement 10 is fabricated by using successive deposition and etching steps. It follows that it is convenient for the layers 50, 52 to be of the same material as the layers 46, 48. Thus, the layers 50, 52 can be of TiAlN and titanium, respectively.

The nozzle arrangement 10 includes an ink-ejecting member in the form of an elongate rectangular paddle 54. The paddle 54 is fixed to the load formation 44 and extends towards the distal end wall 24. Further, the paddle 54 is dimensioned to correspond generally with the nozzle chamber 22. It follows that displacement of the paddle 54 towards and away from the ink ejection port 30 with sufficient energy results in the ejection of an ink drop from the ink ejection port. The manner in which drop ejection is achieved is described in detail in the above referenced patents/applications and is therefore not discussed in any detail here.

To facilitate fabrication, the paddle 54 is of TiAlN. In particular, the paddle 54 is an extension of the layer 50 of the load formation 44 of the lever mechanism 38.

The paddle 54 has corrugations 56 to strengthen the paddle 54 against flexure during operation.

The effort formation 40 is also composite with a primary layer 58 and a secondary layer 60.

The layers 58, 60 can be of any of a number of materials that are used in integrated circuit fabrication. However, as set out above, the nozzle arrangement 10 is fabricated by using successive deposition and etching steps. It follows that it is convenient for the layers 58, 60 to be of the same material as the layers 46, 48. Thus, the layers 58, 60 can be of TiAlN and titanium, respectively.

The nozzle arrangement 10 includes an actuator in the form of a thermal bend actuator 62. The thermal bend actuator 62 is of a conductive material that is capable of being resistively heated. The conductive material has a coefficient of thermal expansion that is such that, when heated and subsequently cooled, the material is capable of expansion and contraction to an extent sufficient to perform work on a MEMS scale.

The thermal bend actuator 62 can be any of a number of thermal bend actuators described in the above patents/patent applications. In one example, the thermal bend actuator 62 includes an actuator arm 64 that has an active portion 82 and a passive portion. The active portion 82 has a pair of inner legs 66 and the passive portion is defined by a leg positioned on each side of the pair of inner legs 66. A bridge portion 68 interconnects the active legs 66 and the passive legs. Each leg 66 is fixed to one of a pair of anchor formations in the form of active anchors 70 that extend from the ink passivation layer 16. Each active anchor 70 is configured so that the legs 66 are electrically connected to the drive circuitry layer 14.

Each passive leg is fixed to one of a pair of anchor formations in the form of passive anchors 88 that are electrically isolated from the drive circuitry layer 14.

Thus, the legs 66 and the bridge portion 68 are configured so that when a current from the drive circuitry layer 14 is set up in the legs 66, the actuator arm 64 is subjected to differential heating. In particular, the actuator arm 64 is shaped so that the passive legs are interposed between at least a portion of the legs 66 and the substrate 12. It will be appreciated that this causes the actuator arm 64 to bend towards the substrate 12.

The bridge portion 68 therefore defines a working end of the actuator 62. In particular, the bridge portion 68 defines the primary layer 58 of the effort formation 40. Thus, the actuator 62 is of TiAlN. The Applicant has found this material to be well suited for the actuator 62.

The lever mechanism 38 includes a lever arm formation 72 positioned on, and fast with, the secondary layers 48, 52, 60 of the fulcrum formation 42, the load formation 44 and the effort formation 40, respectively. Thus, reciprocal movement of the actuator 62 towards and away from the substrate 12 is converted into reciprocal angular displacement of the paddle 54 via the lever mechanism 38 to eject ink drops from the ink ejection port 30.

Each active anchor 70 and passive anchor is also composite with a primary layer and a secondary layer. The layers can be of any of a number of materials that are used in integrated circuit fabrication. However, in order to facilitate fabrication, the primary layer is of TiAlN and the secondary layer is of titanium.

A cover formation 78 is positioned on the anchors 70, 88 to extend over and to cover the actuator 62. Air chamber walls 90 extend between the ink passivation layer 16 and the cover formation 78 so that the cover formation 78 and the air chamber walls 90 define an air chamber 80. Thus, the actuator 62 and the anchors are positioned in the air chamber 80.

The cover formation 78, the lever arm formation 72 and the roof 20 are in the form of a unitary protective structure 92 to inhibit damage to the nozzle arrangement 10.

The protective structure 92 can be one of a number of materials that are used in integrated circuit fabrication. The Applicant has found that silicon dioxide is particularly useful for this task.

It will be appreciated that it is necessary for the lever arm formation 72 to be displaced relative to the cover formation 78 and the roof 20. It follows that the cover formation 78 and the lever arm formation 72 are demarcated by a slotted opening 94 in fluid communication with the air chamber 80. The roof 20 and the lever arm formation 72 are demarcated by a slotted opening 96 in fluid communication with the nozzle chamber 22.

The lever arm formation 72 and the roof 20 together define ridges 98 that bound the slotted opening 96. Thus, when the nozzle chamber 22 is filled with ink, the ridges 98 define a fluidic seal during ink ejection. The ridges 98 serve to inhibit ink spreading by providing suitable adhesion surfaces for a meniscus formed by the ink.

The slotted openings 94, 96 demarcate a torsion formation 100 defined by the protective structure 92. The torsion formation 100 serves to support the lever mechanism 38 in position. Further, the torsion formation 100 is configured to experience twisting deformation in order to accommodate pivotal movement of the lever mechanism 38 during operation of the nozzle arrangement 10. The silicon dioxide of the protective structure 92 is resiliently flexible on a MEMS scale and is thus suitable for such repetitive distortion.

Applicant believes that this invention provides a printhead chip that is resistant to damage during handling. The primary reason for this is the provision of the protective structure 92, which covers the moving components of the nozzle arrangements of the printhead chip. The protective structure 92 is positioned in a common plane. It follows that when a plurality of the nozzle arrangements 10 are positioned together to define the printhead chip, the printhead chip presents a substantially uniform surface that is resistant to damage.

I claim:

1. An inkjet printhead integrated circuit comprising:

a substrate;

a drive circuitry layer positioned on the substrate, the substrate and the drive circuitry layer defining a plurality of ink inlet channels;

nozzle chamber walls positioned on the substrate, the nozzle chamber walls supporting roof structures to define nozzle chambers in fluid communication with the ink inlet channels;

ink ejection ports defined in the roof structures;

ink ejection members positioned in respective nozzle chambers and displaceable with respect to the roof structures to eject ink from the ink ejection ports;

fulcrum formations fast with the substrate, each fulcrum formation having an effort formation on one side and a load formation on an opposite side; and thermal actuators outside of and associated with respective nozzle chambers and connected to the drive circuitry layer to move with respect to the substrate on receipt of electrical signals from the drive circuitry layer, wherein each ink ejection member is fast with a respective load formation, each effort formation is fast with a respective thermal actuator, whereby reciprocal movement generated by the thermal actuators results in reciprocal movement of the ink ejection members and subsequent ink drop ejection from the ink ejection ports, the fulcrum, effort and load formations are composite with a primary layer and a secondary layer, and the ink ejecting members, the thermal actuators, and the secondary layer are of the same material.

2. An inkjet printhead integrated circuit as claimed in claim 1, wherein the load formations respectively define at least one of the walls of each nozzle chambers.

3. An inkjet printhead integrated circuit as claimed in claim 2, wherein the fulcrum formations are resiliently deformable to permit pivotal movement of the fulcrum formations relative to the substrate.

* * * * *